US012215692B1

(12) United States Patent
Stratman

(10) Patent No.: US 12,215,692 B1
(45) Date of Patent: Feb. 4, 2025

(54) SCAVENGE LOSS LIMITER FOR A ROTARY COMPRESSOR

(71) Applicant: Ingersoll-Rand Industrial U.S., Inc., Davidson, NC (US)

(72) Inventor: Taylor Stratman, Quincy, IL (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 18/581,865

(22) Filed: Feb. 20, 2024

(51) Int. Cl.
*F04C 29/00* (2006.01)
*F04C 18/16* (2006.01)
*F04C 29/02* (2006.01)

(52) U.S. Cl.
CPC ..... *F04C 29/026* (2013.01); *F04C 18/165* (2013.01); *F04C 29/0028* (2013.01); *F04C 29/028* (2013.01); *F04C 2210/1005* (2013.01); *F04C 2210/14* (2013.01); *F04C 2240/30* (2013.01); *F04C 2240/50* (2013.01)

(58) Field of Classification Search
CPC .. F04C 29/026; F04C 29/0028; F04C 29/028; F04C 29/12; F04C 29/00; F04C 29/0007; F04C 18/165; F04C 18/16; F04C 2/16; F04C 2/084; F04C 2210/1005; F04C 2210/14; F04C 2240/30; F04C 2240/50
See application file for complete search history.

(56) References Cited

U.S. PATENT DOCUMENTS

| | | | | |
|---|---|---|---|---|
| 7,318,712 | B2 * | 1/2008 | Arnold | F01C 21/106 418/104 |
| 8,834,140 | B2 * | 9/2014 | Arnold | F01C 21/005 418/71 |
| 9,797,299 | B2 * | 10/2017 | Hansen | F02B 39/06 |
| 10,995,751 | B2 * | 5/2021 | Chu | F04C 15/0019 |
| 11,168,683 | B2 * | 11/2021 | Gottfried | F04C 9/005 |
| 11,614,089 | B2 * | 3/2023 | Juan | F04C 29/00 418/91 |
| 2017/0122189 | A1 * | 5/2017 | Hansen | F04C 28/265 |
| 2019/0072095 | A1 * | 3/2019 | Lanum | F04C 18/16 |

* cited by examiner

*Primary Examiner* — Dapinder Singh
(74) *Attorney, Agent, or Firm* — Kevin E. West; Advent, LLP

(57) ABSTRACT

A fluid compressor system has a scavenge loss limiter that increases the efficiency of the fluid compressor system by reducing the compressed working fluid recirculated into the airend through a scavenge flow. The scavenge loss limiter includes a scavenge hole positioned at a discharge end face of a rotor cavity of the compressor housing. As a rotor of the compressor system rotates, the rotor may intermittently restrict the free-flowing scavenge flow returning from a lubricant separation tank. The rotor may be a male rotor having a plurality of male lobes. As the discharge end clearance between the rotor and the discharge end face is tightly controlled and monitored, a better control of the scavenge flow returning to the rotor cavity is achieved.

20 Claims, 13 Drawing Sheets

SCAVENGE LOSS LIMITER FOR A ROTARY COMPRESSOR

BACKGROUND

Fluid compressor systems are widely used in a variety of industries such as in construction, manufacturing, agriculture, energy production, etc. As fluid compressors compress a working fluid, heat is produced as a result of the pressure increase in the working fluid. To reduce the heat produced by the compression process and lubricate mechanical components, compressor systems may inject a lubricant (e.g., oil, etc.) into the compressor airend. These compressors are known as contact-cooled compressors.

DRAWINGS

The Detailed Description is described with reference to the accompanying figures. The use of the same reference numbers in different instances in the description and the figures may indicate similar or identical items.

DETAILED DESCRIPTION

Figure 1:
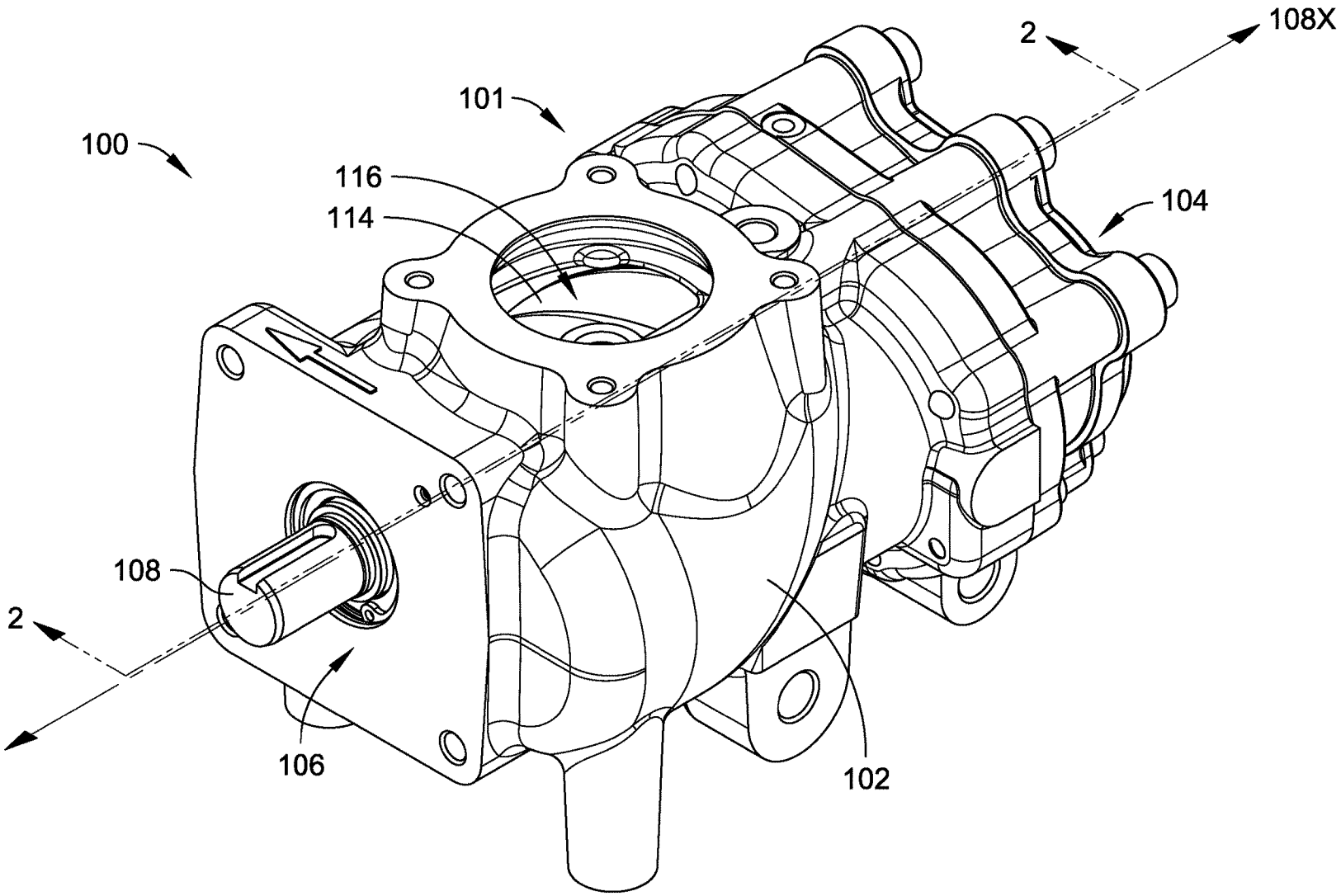
FIG. 1 is an isometric view illustrating a rotary compressor with a scavenge loss limiter in accordance with example embodiments of the present disclosure.

For the purposes of promoting an understanding of the principles of the subject matter, reference will now be made to the embodiments illustrated in the drawings and specific language will be used to describe the same. It will nevertheless be understood that no limitation of the scope of the subject matter is thereby intended. Any alterations and further modifications in the described embodiments, and any further applications of the principles of the subject matter as described herein are contemplated as would normally occur to one skilled in the art to which the subject matter relates.

Overview

Contact-cooled compressors, such as rotary screw compressors, separate the working fluid (e.g., air, gas, etc.) from the lubricant and other undesired particles in a separator process. The separation process starts in an oil sump in a separator tank, where a majority of the lubricant (around 95%) is separated from the compressed working fluid. The compressed working fluid is then directed to a coalescing-type filter. The coalescing-type filter intercepts and coalesces the remaining aerosol lubricant stream in the compressed working fluid as it exits the initial inertial separation process within the oil sump.

The coalescing-type filter includes a scavenge tube configured to take in the lubricant separated in the coalescing-type filter and recirculates it back into the compressor airend. The scavenge tube includes an orifice that controls the amount of lubricant and compressed working fluid that is returned or recirculated back into the compressor. This scavenge flow that is recirculated represents a loss in compressed working fluid delivered to the end-user. This scavenge loss is especially significant in small and variable speed compression systems (5 hp to 60 hp). The scavenge loss is even more significant when these small and variable speed compressors are running at their respective minimum speeds.

Less than one percent (1%) of scavenge flow corresponds to the lubricant, and almost the entirety of the scavenge flow corresponds to a loss of compressed working fluid. Typical compressors may include a scavenge return hole disposed on a rotor housing, located radially from an axis of rotation of a female rotor. There is a need for a compressor that limits compressed working fluid loss through scavenge flow, hereinafter referred to as scavenge loss.

Accordingly, the present disclosure is directed to a fluid compressor system having a scavenge loss limiter that increases the efficiency of the fluid compressor system by reducing the compressed working fluid recirculated into the airend. The scavenge loss limiter includes a scavenge orifice positioned at a discharge end of the compressor housing, for example, at an end face of a rotor cavity. As a rotor of the compressor system rotates, the rotor may intermittently restrict the free-flowing scavenge flow returning from the coalescent-type filter. The rotor may be a male rotor having a plurality of male lobes or a female rotor having a plurality of female lobes. As the discharge end clearance between the rotor and the discharge end face is tightly controlled and monitored, a better control of the scavenge flow returning to the rotor cavity is achieved.

The compressor system can be used with any type of fluid compression device and should not be limited to the illustrative fluid compressor system shown in any of the accompanying figures. The term "fluid" should be understood to include any compressible fluid medium that can be used in the fluid compressor system as disclosed herein. It should be understood that air is a typical working fluid, but different fluids or mixtures of fluid constituents can be used and remain within the teaching of the present disclosure. Therefore, terms such as fluid, air, compressible gas, etc. can be used interchangeably in the present disclosure. For example, in some embodiments it is contemplated that ambient air, a hydrocarbon gaseous fuel including natural gas or propane, or inert gases including nitrogen or argon may be used as a primary working fluid. The fluid compressor system may include a compressor with multi-stage compression or a compressor with single stage compression. Other forms and configurations of compression devices are also contemplated herein. The fluid compressor system may include a rotary screw compressor. However, it is contemplated that other types of contact-cooled compressor systems may be used in different embodiments.

Detailed Description of Example Embodiments

Referring generally to FIGS. 1 through 13, a compressor system 1000 having a contact-cooled airend or compressor 100 with a scavenge loss limiter is described. Compressor 100 includes a compressor housing 102 having a first end 104 and a second end 106. The compressor housing 102 defines an inlet 101 configured to receive a working fluid (e.g., air, gas, etc.) for compressing. A rotor cavity 116 is defined between the first end 104 and the second end 106. The compressor housing 102 further includes a first interior wall 118 located proximate to the first end 104. In example embodiments, the first end 104 is a discharge end of the compressor 100.

The compressor housing 102 houses at least one rotor configured to rotate around a rotor axis. For example, a first rotor 110 includes a rotor shaft 108 having a first plurality of helically disposed lobes 112, a rotor end face 111, and a rotor root 113 between adjacent lobes 112. The compressor 100 further includes a bearing assembly 130 disposed within a bearing cavity 134 positioned by the first end 104 of the housing 102. The bearing assembly 130 supports the rotor shaft 108 of the first rotor 110. The bearing assembly 130 may include at least one bearing, for example a needle roller bearing, a ball bearing, an angular contact ball bearing, or a combination thereof.

As the compressor 100 runs, the rotor shaft 108 rotates around a rotor axis 108X. The rotor axis 108X extends from the first end 104 to the second end 106. In the example embodiment shown, the first plurality of lobes 112 is a plurality of male lobes. The lobes 112 have a maximum radius $R_{max}$ with respect to the rotor axis 108X. The rotor root 113 has a radius $R_O$ from the rotor axis 108X.

The compressor housing 102 may also house a second rotor 114 configured to rotate around a second axis, where the second axis is parallel to the rotor axis 108X. In other embodiments, the rotor axis 108X and the second axis may be disposed at an angle greater than zero degrees (00). The second rotor 114 includes a second plurality of lobes 115 configured to intermesh with the first plurality of lobes 112 to compress the working fluid. In the embodiment shown, the second plurality of lobes 115 is a plurality of female lobes having a thinner profile than the plurality of male lobes 112.

The working fluid is injected with a lubricant for cooling and lubrication of the rotors and other mechanical components of the compressor 100. The working fluid is then compressed as it travels from the second end 106 to the first end 104. A compressed working fluid/lubricant mixture is discharged into a separator tank 200. The separator tank 200 is configured to separate the lubricant from the compressed working fluid prior to delivery of the compressed working fluid. The separator tank 200 is in fluid communication with a coalescent-type filter 300 configured to further separate lubricant droplets from the working fluid. As the lubricant droplets collect at the bottom of the coalescent-type filter 300, a scavenge pipe 302 absorbs the collected lubricant along with compressed working fluid and recirculates it back into the compressor 100 through a scavenge tube 304.

To minimize compressed work fluid losses recirculated into the scavenge flow, the compressor 100 includes a scavenge flow limiter 120 connected to the scavenge tube 304. The scavenge flow limiter 120 includes a scavenge passage 122 and a scavenge orifice 124. The scavenge passage 122 is disposed within the first interior wall 118 on the discharge end of the compressor 100. The scavenge passage 122 receives the scavenge flow from the scavenge tube 304 and releases the scavenge flow into the rotor cavity 116 through the scavenge orifice 124.

Figure 2:
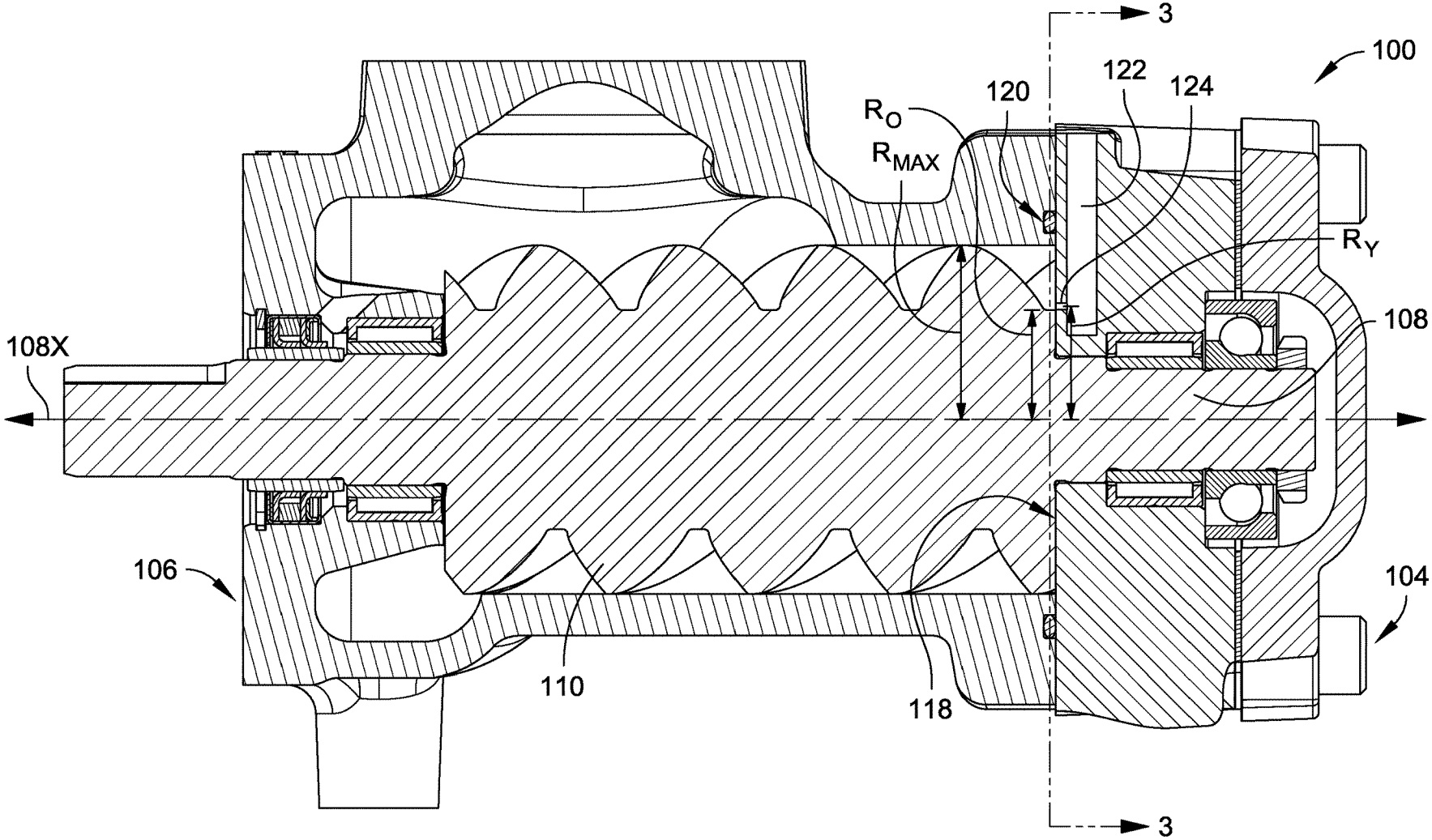
FIG. 2 is a cross-sectional side view of a rotary compressor, as shown in FIG. 1 along line 2-2, the rotary compressor having a male root scavenge limiter in accordance with example embodiments of the present disclosure.
Figure 3:
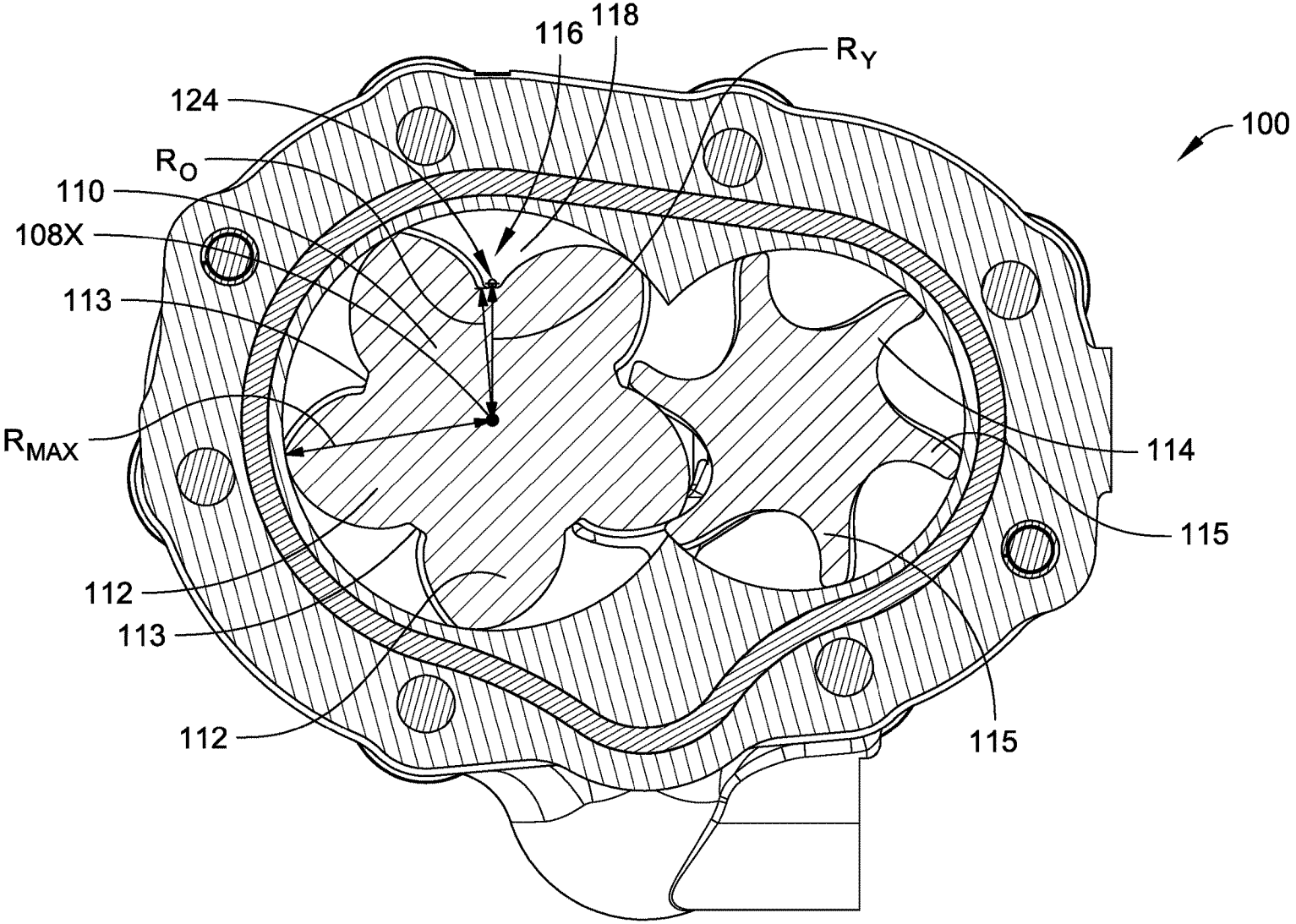
FIG. 3 is a cross-sectional front view of the rotary compressor shown in FIG. 2 along line 3-3, having a scavenge limiter orifice in accordance with example embodiments of the present disclosure.
Figure 4:
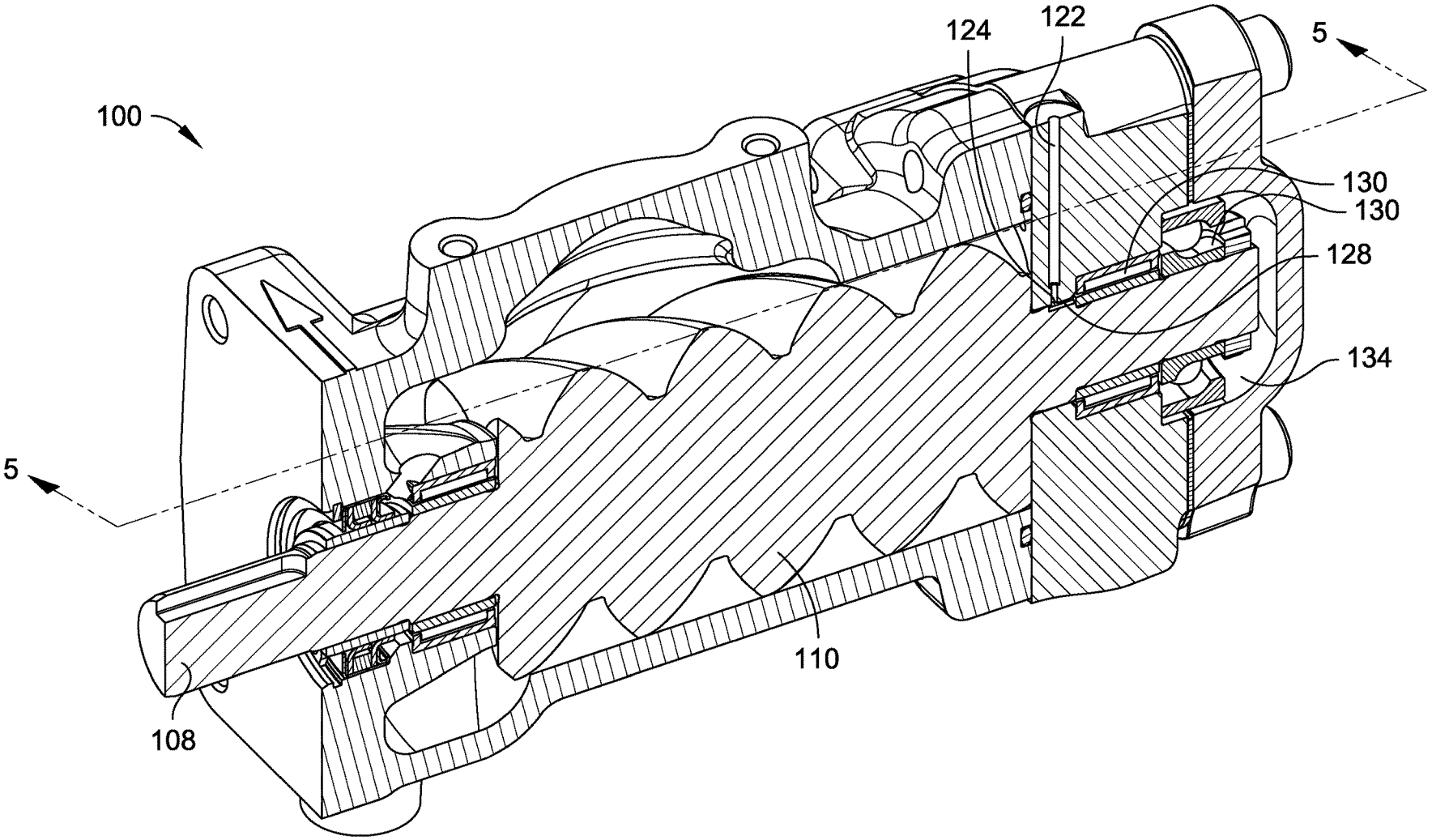
FIG. 4 is a cross-sectional isometric view of a rotary compressor, as shown in FIG. 1, the rotary compressor having a shaft scavenge limiter in accordance with example embodiments of the present disclosure.
Figure 5:
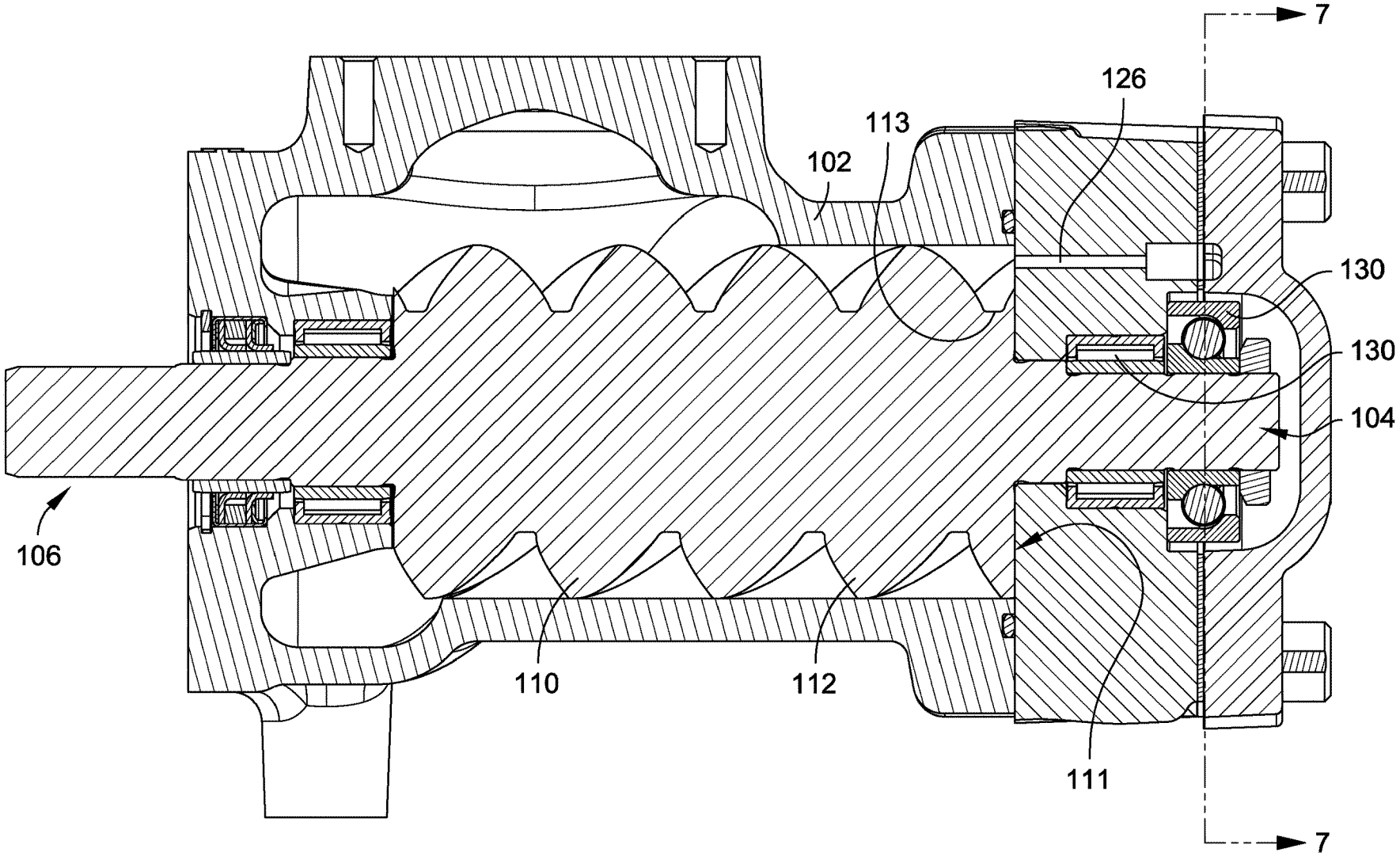
FIG. 5 is a cross-sectional top view of the rotary compressor as shown in FIG. 4, the rotary compressor having a shaft scavenge limiter in accordance with example embodiments of the present disclosure.
Figure 6:
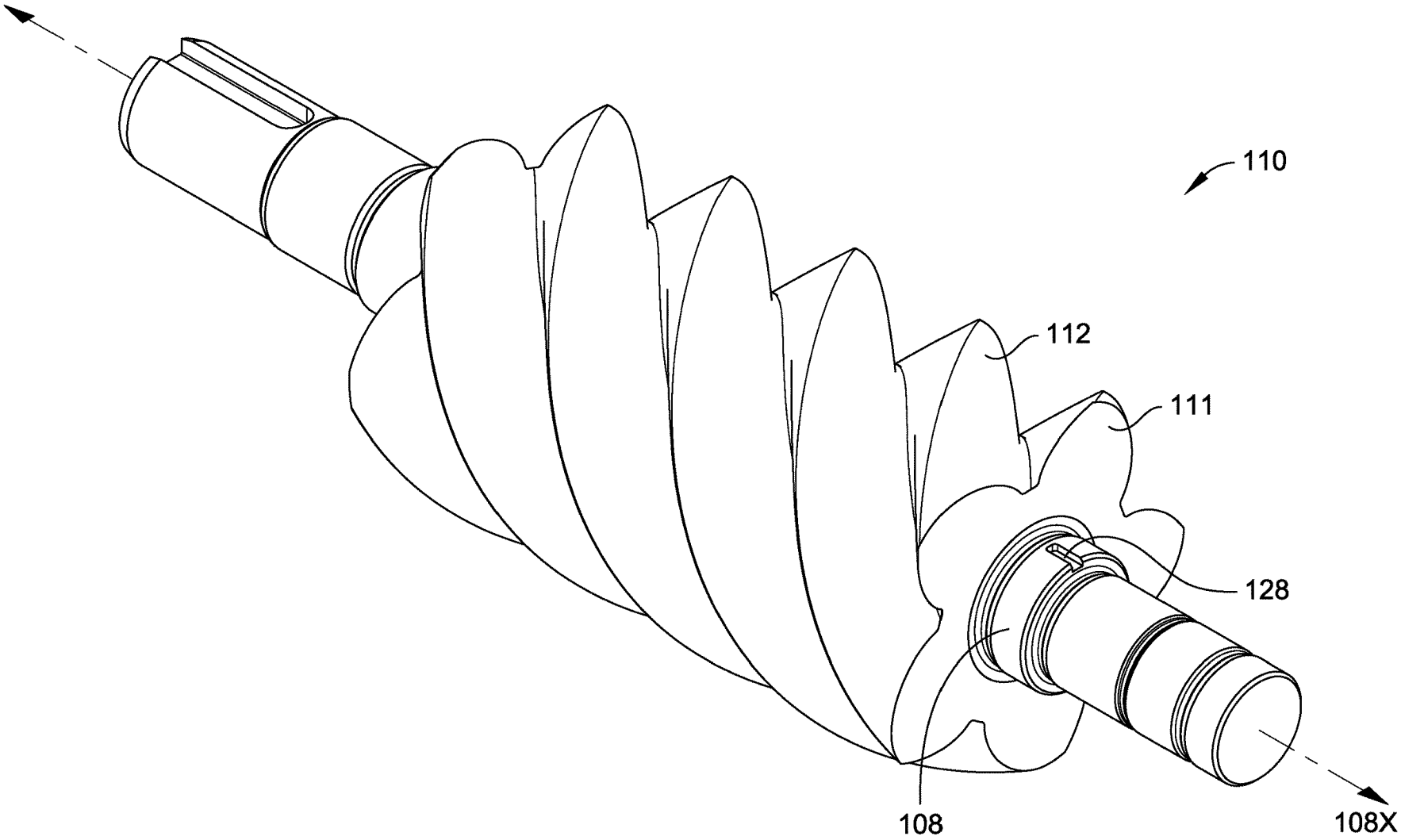
FIG. 6 is an isometric view of a rotor shaft, as shown in FIG. 4, the rotor shaft having a shaft scavenge groove in accordance with example embodiments of the present disclosure.

In the embodiment shown in FIGS. 2 and 3, the scavenge orifice 124 is positioned above a root 113 of the rotor 110, between adjacent rotor lobes 112. The scavenge orifice 124 may be positioned at an orifice radius $R_Y$ from the rotor axis 108X, where the orifice radius $R_Y$ is greater than the rotor root radius $R_O$ and less than the rotor lobe 112 maximum radius $R_{max}$.

As the first rotor 110 rotates, the rotor end face 111 of the plurality of lobes 112 intermittently cover and uncover the scavenge orifice 124, opening and closing the scavenge orifice 124 to the rotor cavity 116. In example embodiments, the rotor end face 111 and the first interior wall 118 are adjacent to each other and have a discharge end clearance (DEC) ranging from fifteen to twenty-five micrometers (15-25 μm). In example embodiments, the DEC is twenty micrometers (20 μm). The clearance between the first interior wall 118 and the rotor end face 111 allows the rotor lobes 112 to block the scavenge flow recirculating back into the rotor cavity 116 until the rotor 110 rotates to uncover the scavenge orifice 124. The scavenge orifice may have a diameter between one-half millimeter and two millimeters (0.5-2 mm). In example embodiments, the scavenge orifice has a diameter of one millimeter (1 mm). In the embodiment shown in FIGS. 2 and 3, the rotor 110 blocks the scavenge orifice 124 for most of the compression cycle while still allowing the scavenge flow to recirculate into the rotor cavity 116.

FIGS. 4 through 7 show an example embodiment of the compressor 100 having a shaft scavenge loss limiter, where the rotor 110 has at least one scavenge groove 128 machined into the surface of the rotor shaft 108. The scavenge passage 122 may direct the scavenge flow into the at least one scavenge groove 128 once per revolution of the rotor shaft 108. The scavenge groove 128 fluidly connects the scavenge orifice 124 with the bearing assembly 130. Once the scavenge flow flows into the scavenge groove 128, the scavenge flow is directed to and lubricates the bearing assembly 130. The scavenge flow may then be directed back into the rotor cavity 116 through a return passage 126. In example embodiments, the scavenge loss limiter 120 includes a lubrication passage disposed between and fluidly connecting the scavenge groove 128 and the bearing assembly 130.

Figure 8:
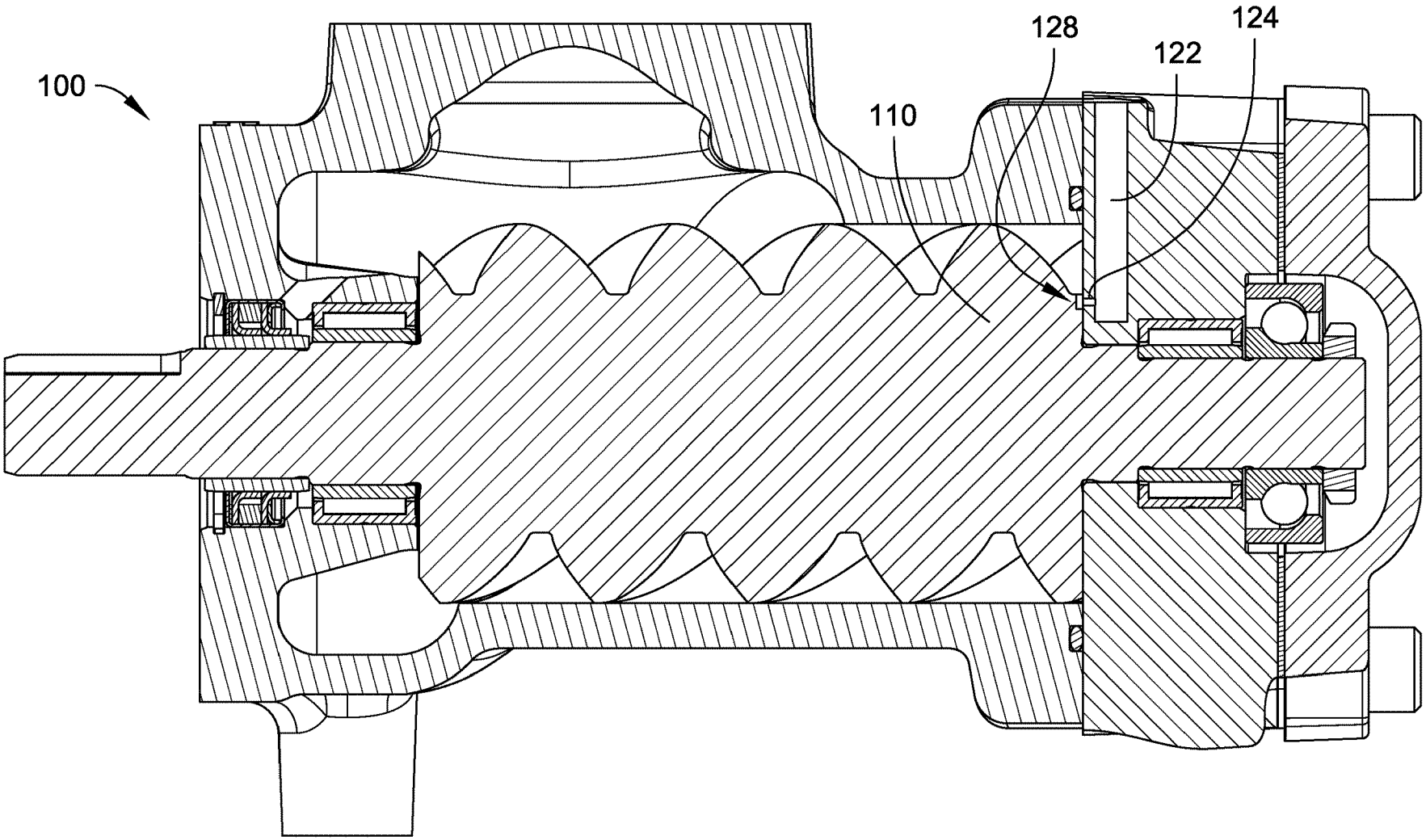
FIG. 8 is a cross-sectional side view of a rotary compressor, as shown in FIG. 1, the rotary compressor having a rotor orifice scavenge limiter in accordance with example embodiments of the present disclosure.
Figure 9:
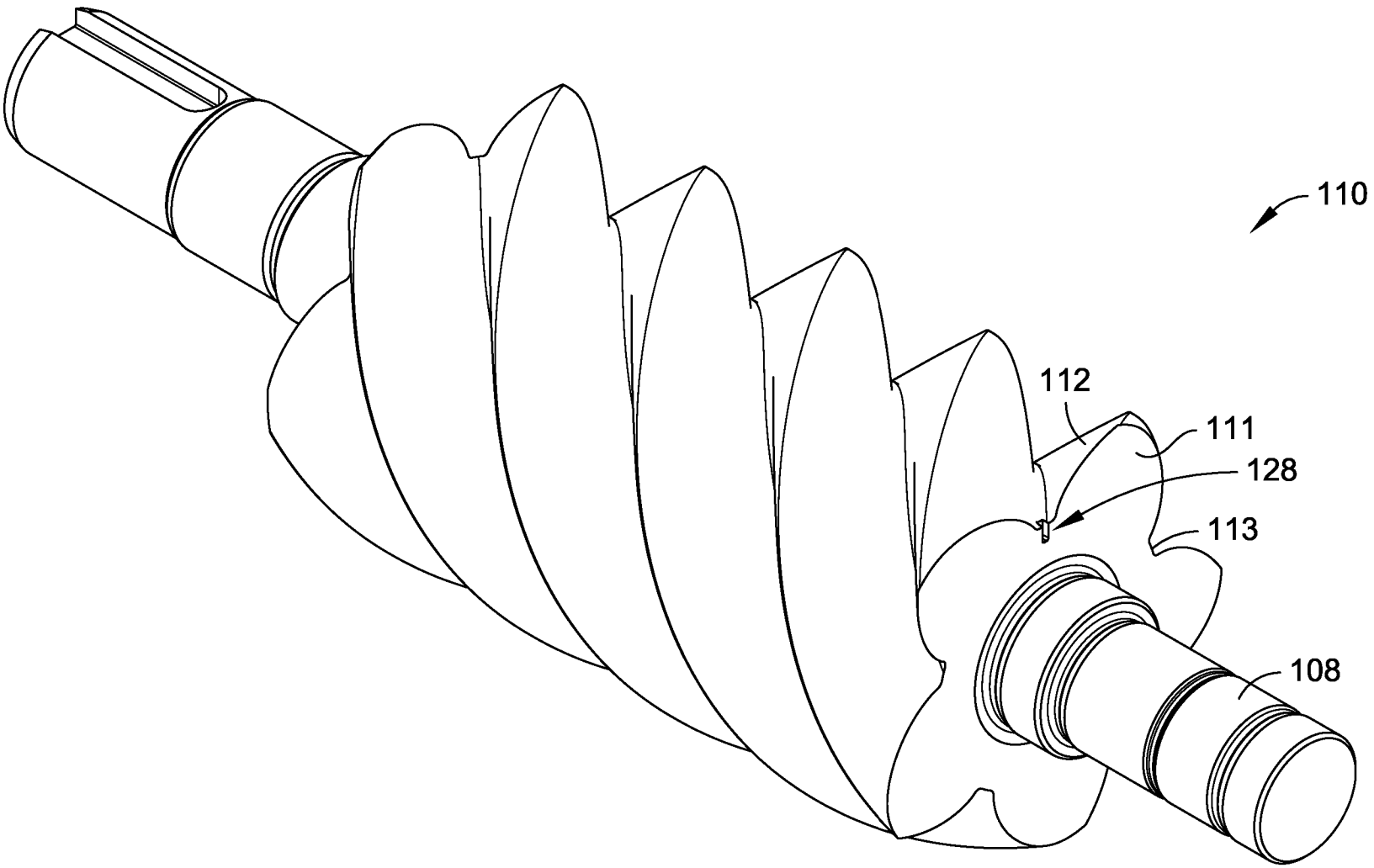
FIG. 9 is an isometric view of the rotor shown in FIG. 8, the rotor having a rotor scavenge orifice in accordance with example embodiments of the present disclosure.

In other embodiments, such as the one shown in FIGS. 8 and 9, the scavenge orifice 124 is located at a radius $R_Y$ that is less than or equal to the rotor root radius $R_O$. The scavenge groove 128 is machined in the rotor end face 111 at the rotor root 113 and is open to the rotor cavity 116. As the rotor 110 rotates, the scavenge orifice 124 is blocked and the scavenge flow is restricted from entering the rotor cavity 116 until the scavenge groove 128 is aligned with the scavenger orifice 124.

Figure 10:
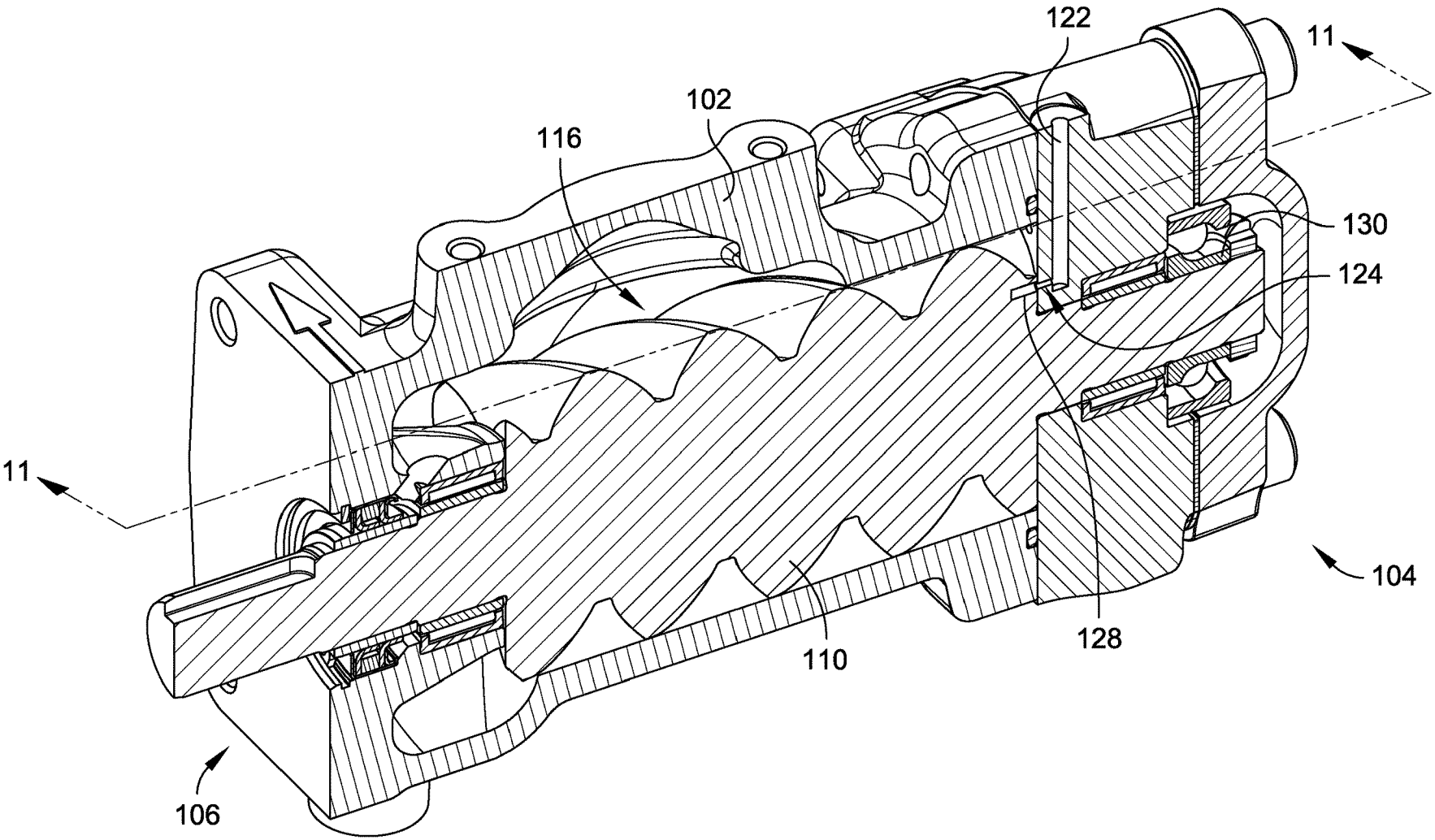
FIG. 10 is a cross-sectional isometric view of a rotary compressor, as shown in FIG. 1, a rotor of the rotary compressor having a blind-orifice scavenge limiter in accordance with example embodiments of the present disclosure.
Figure 11:
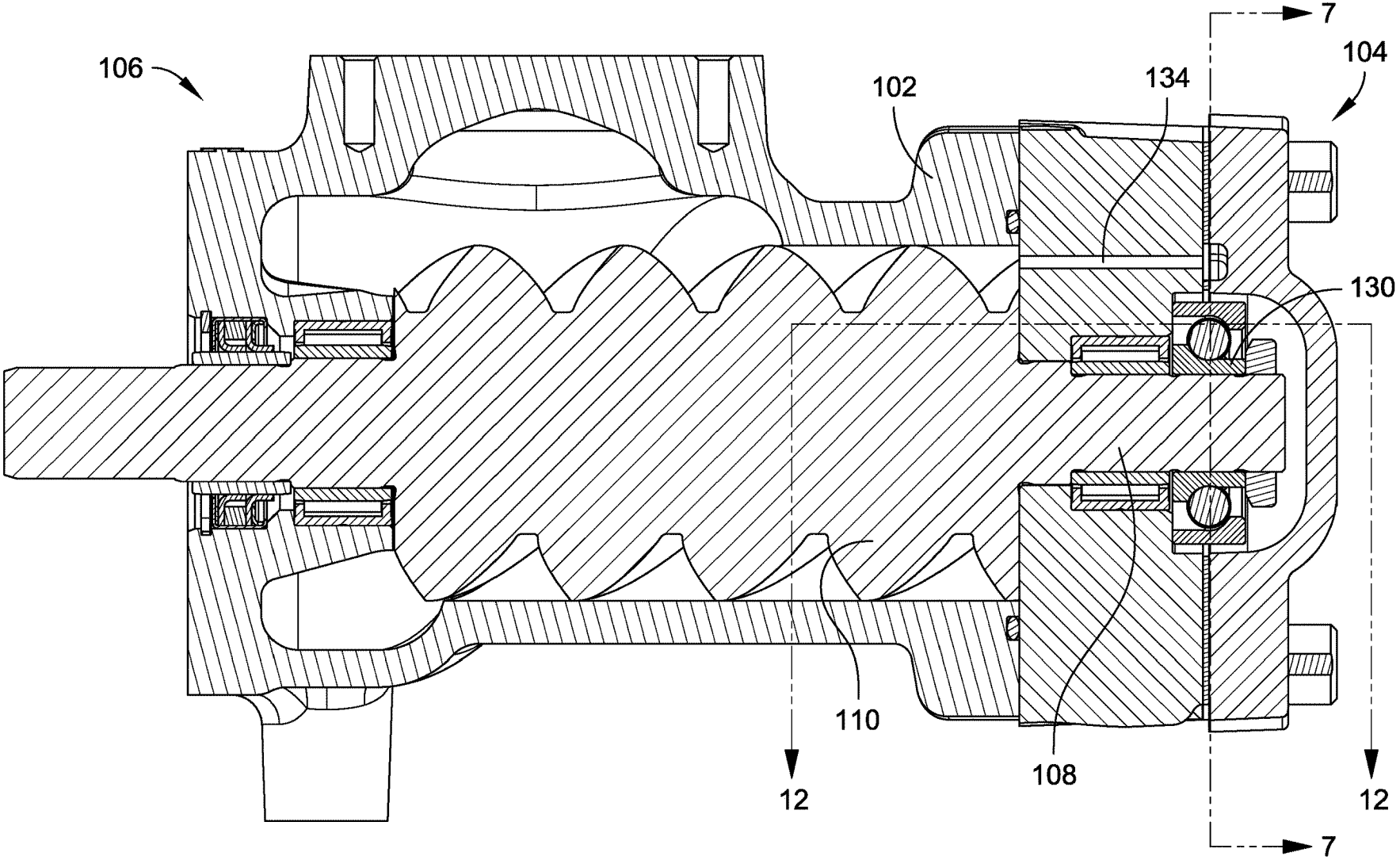
FIG. 11 is a cross-sectional side view of the rotary compressor of FIG. 10, along line 11-11, the rotary compressor having a bearing return passage connecting a bearing assembly with a rotor cavity in accordance with example embodiments of the present disclosure.
Figure 12:
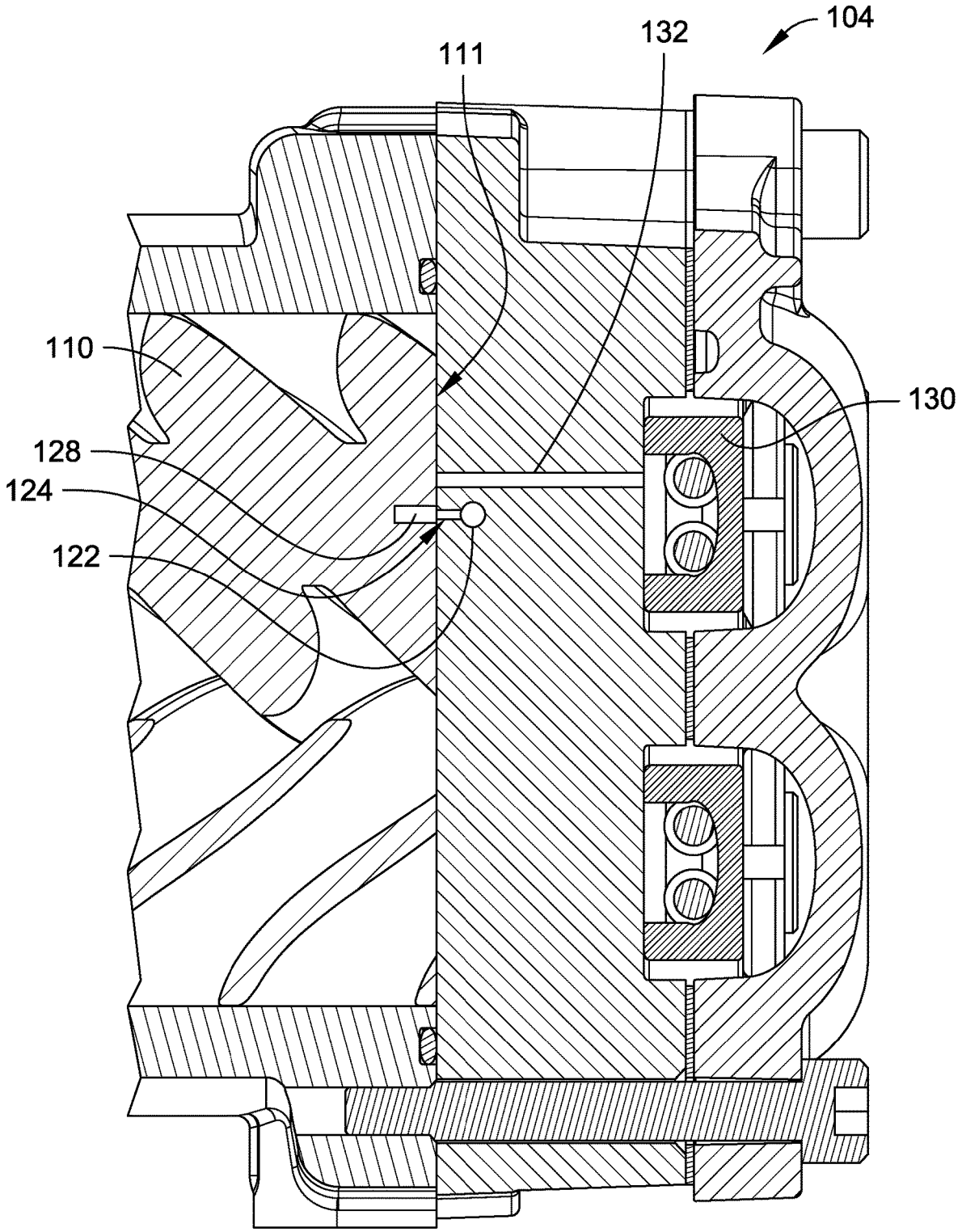
FIG. 12 is a partial cross-sectional top view of the rotary compressor of FIG. 11 along line 12-12, showing a rotor blind-orifice and a bearing lubrication passage in accordance with example embodiments of the present disclosure.

In other embodiments, as shown in FIGS. 10 through 12, where the scavenge orifice 124 is located at a radius $R_Y$ that is less than the rotor root radius $R_O$, the scavenge groove 128 may be machined in the rotor end face 111 below the rotor root 113. In this embodiment, the scavenge groove 128 is not open to the rotor cavity 116. The scavenge groove 128 may be a blind hole configured to act as a scavenge flow storage pocket, wherein the scavenge flow discharged from the scavenge orifice 124 is stored in the scavenge groove 128 until the rotor 110 rotates and aligns the scavenge groove 128 with a lubrication passage 132. The scavenge groove 128 vents the scavenge flow stored into the lubrication passage 132.

Figure 7:
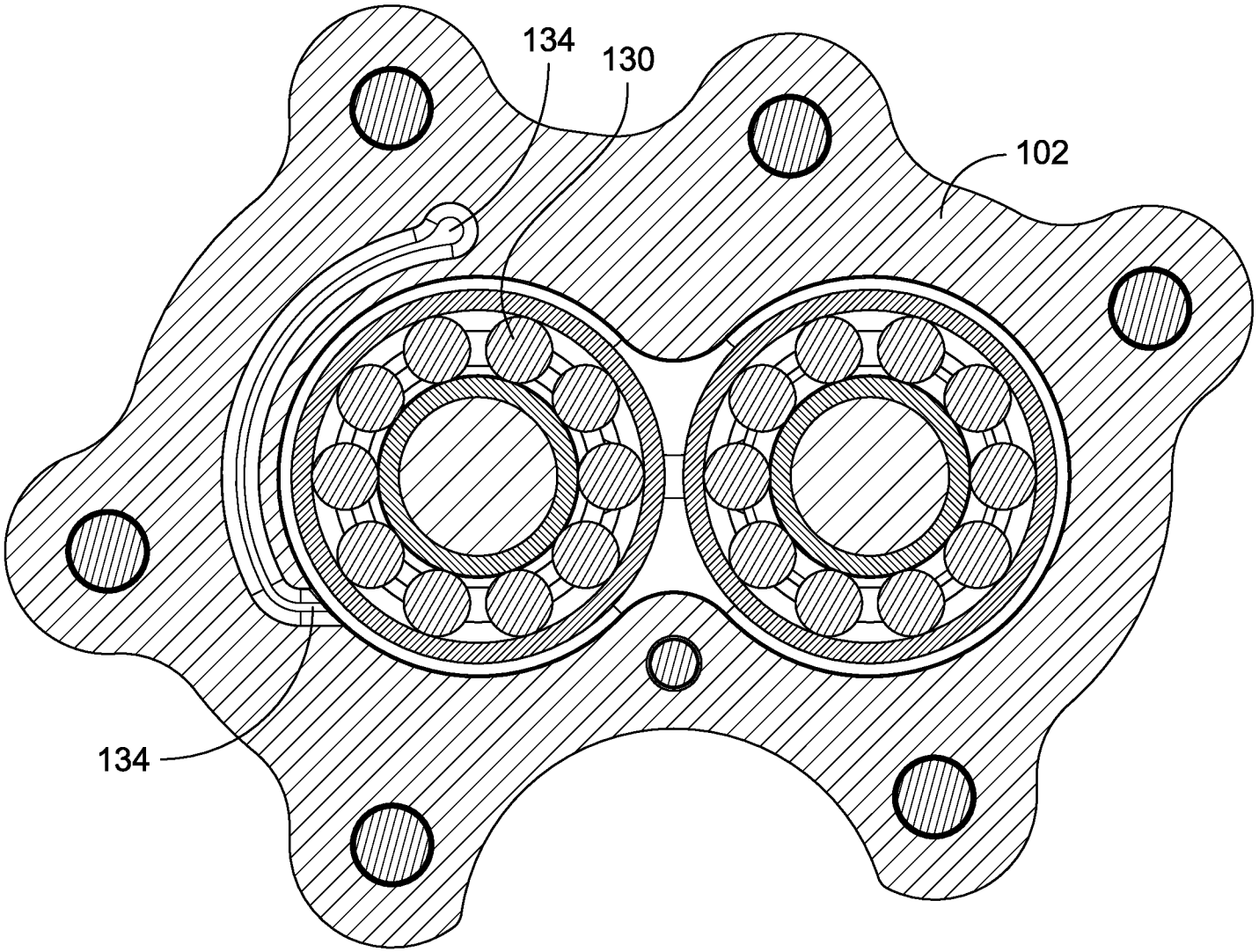
FIG. 7 is a cross-sectional front view of the rotary compressor shown in FIG. 5 along line 7-7, showing a bearing return passage connecting a bearing assembly with a rotor cavity in accordance with example embodiments of the present disclosure.

The lubrication passage 132 may direct the scavenge flow into the bearing assembly 130. After passing through the bearing assembly 130, the scavenge flow is redirected into the rotor cavity 116 through a return passage 126 as shown in FIG. 7. The scavenge flow may be routed to the bearing assembly 130 to assist with the draining of the stored scavenge flow in the scavenge groove 128 and to help circulate any oil accumulating in the bearing cavity 134 back into the rotor cavity 116.

Figure 13:
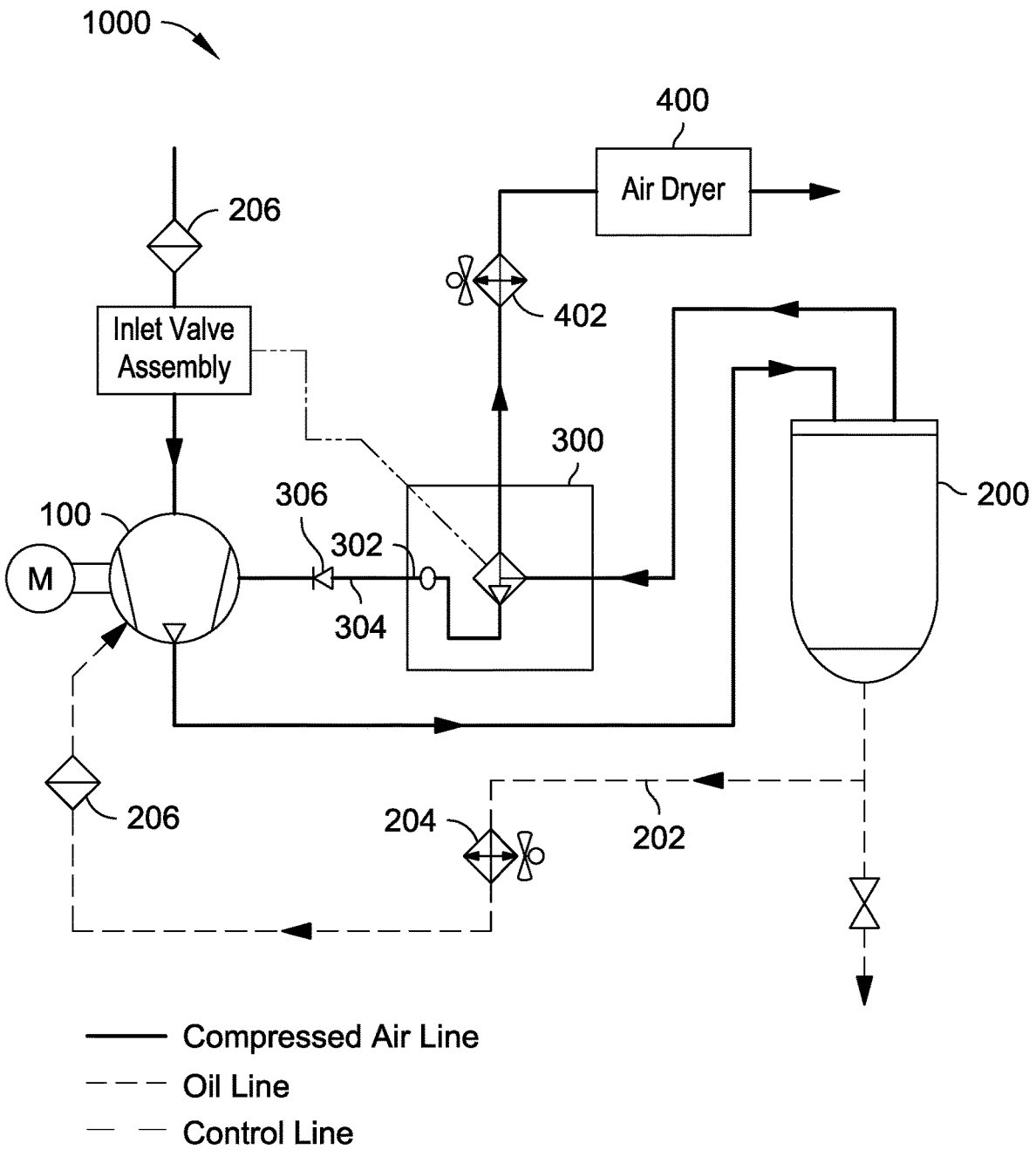
FIG. 13 is a schematic view of a compressor system including a contact-cooled rotary compressor and a separator tank in accordance with example embodiments of the present disclosure.

As shown in FIG. 13 the compression system 1000 may include one contact-cooled airend or compressor 100. In other embodiments, the compression system may include a plurality of compressors 100 in fluid communication with a separator tank 200 and a coalescent-type filter 300. The compression system 1000 may further include a check valve 306 coupled between the scavenge tube 304 and the compressor 100. The check valve 306 is configured to prevent backflow of the scavenge flow into the separator tank 200 and the coalescent-type filter 300 upon unit stoppage.

The storage tank 200 is coupled to an oil line 202 redirecting the lubricant pooled at the bottom of the separator tank 200 to recirculate the lubricant into the compressor 100. The oil line 202 may include a cooling fan 204 and a filter element 206 configured to respectively cool and filter the recirculating lubricant prior to injecting into the rotor cavity 106. The coalescing-type filter 300 is coupled to an after-cooler 402 that cools the compressed working fluid prior to it being delivered. The compression system 1000 may also include an air dryer 400 connected to the after-cooler 402.

While the subject matter has been illustrated and described in detail in the drawings and foregoing description, the same is to be considered as illustrative and not restrictive in character, it being understood that only the preferred embodiments have been shown and described and that all changes and modifications that come within the spirit of the subject matters are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the subject matter, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A rotary compressor comprising:

a housing having a first housing end, a second housing end, and a rotor cavity defined between the first housing end and the second housing end, the housing including a first interior wall proximate to the first housing end;

a first rotor housed within the rotor cavity and rotating about a first rotor axis extending from the first housing end to the second housing end, the first rotor having a plurality of male lobes;

a second rotor housed within the rotor cavity and rotating about a second rotor axis extending from the first housing end to the second housing end, the second rotor having a plurality of female lobes, the plurality of female lobes configured to intermesh with the plurality of male lobes to compress a working fluid; and a scavenge loss limiter disposed within the first interior wall, the scavenge loss limiter comprising a scavenge passage and a scavenge orifice;

wherein, as the first rotor rotates, the first rotor intermittently covers and uncovers the scavenge orifice opening and closing the scavenge orifice, and wherein the scavenge loss limiter is configured to recirculate scavenge flow from an oil separator into the rotor cavity as the rotation of the first rotor intermittently uncovers the scavenge orifice.

2. The rotary compressor of claim 1, wherein the first rotor comprises a first rotor root radius and a male lobe maximum radius from the first rotor axis, and wherein the scavenge orifice is disposed at an orifice radius from the first rotor axis, where the orifice radius is greater than the first rotor root radius and less than the male lobe maximum radius.

3. The rotary compressor of claim 1, wherein the first housing end comprises a bearing assembly, and wherein the scavenge passage is configured to direct a scavenge flow through the bearing assembly prior to recirculating the scavenge flow into the rotor cavity.

4. The rotary compressor of claim 3, wherein the first rotor includes a scavenge groove configured to receive the scavenge flow from the scavenge passage.

5. The rotary compressor of claim 4, wherein the scavenge groove is disposed in a first rotor shaft of the first rotor.

6. The rotary compressor of claim 4, wherein the bearing assembly comprises a bearing cavity, and wherein the scavenge groove directs the scavenge flow to the bearing cavity, the bearing cavity configured to be lubricated by the scavenge flow.

7. The rotary compressor of claim 4, wherein the first rotor comprises a first rotor end face, and wherein the scavenge groove is disposed on the first rotor end face.

8. The rotary compressor of claim 7, wherein the scavenge groove is open to the rotor cavity.

9. A rotary compressor comprising:

a housing having a first housing end, a second housing end, and a rotor cavity defined between the first housing end and the second housing end, the housing including a first interior wall proximate to the first housing end;

a first rotor housed within the rotor cavity, rotating about a first rotor axis, the first rotor axis extending from the first housing end to the second housing end; and a scavenge loss limiter disposed within the first interior wall, the scavenge loss limiter including a scavenge passage and a scavenge orifice, the scavenge orifice connecting the scavenge passage with the rotor cavity;

wherein the first rotor rotates intermittently opening and closing the scavenge orifice, and wherein the scavenge loss limiter is configured to recirculate scavenge flow from an oil separator into the rotary rotor cavity intermittently as the rotation of the first rotor opens the scavenge orifice.

10. The rotary compressor of claim 9, further comprising a second rotor housed within the rotor cavity, wherein the first rotor includes a plurality of helical male lobes, and the second rotor includes a plurality of helical female lobes, the male lobes intermeshing with the female lobes and compressing a working fluid.

11. The rotary compressor of claim 10, wherein the scavenge orifice is disposed at an orifice radius from the first rotor axis, where the orifice radius is greater than a first rotor root radius and less than a male lobe maximum radius.

12. The rotary compressor of claim 9, wherein the scavenge passage is configured to direct a scavenge flow through a bearing assembly prior to recirculating the scavenge flow into the rotor cavity.

13. The rotary compressor of claim 12, wherein the first rotor includes a scavenge groove configured to receive the scavenge flow from the scavenge orifice.

14. The rotary compressor of claim 13, wherein the scavenge groove is disposed in a first rotor shaft of the first rotor.

15. The rotary compressor of claim 13, wherein the scavenge groove directs the scavenge flow to a bearing cavity, the bearing cavity configured to be lubricated by the scavenge flow.

16. The rotary compressor of claim 13, wherein the scavenge groove is disposed on a first rotor end face.

17. The rotary compressor of claim 16, wherein the scavenge groove is open to the rotor cavity.

18. A compressor system comprising:

an airend configured to compress a working fluid, the airend including:

a housing having a first housing end, a second housing end, and a rotor cavity defined between the first housing end and the second housing end, the housing including a first interior wall proximate to the first housing end;

a first rotor housed within the rotor cavity, rotating about a first rotor axis, the first rotor axis extending from the first housing end to the second housing end; and a scavenge loss limiter disposed within the first interior wall, the scavenge loss limiter including a scavenge passage and a scavenge orifice, the scavenge orifice connecting the scavenge passage with the rotor cavity; and a lubricant separator configured to separate a lubricant from the working fluid, the lubricant separator delivering a scavenge flow to the airend;

wherein the first rotor rotates intermittently opening and closing the scavenge orifice, and wherein the scavenge loss limiter is configured to recirculate the scavenge flow into the rotary rotor cavity intermittently as the rotation of the first rotor opens the scavenge orifice.

19. The compressor system of claim 18, wherein the scavenge orifice is disposed at an orifice radius from the first rotor axis, where the orifice radius is greater than a first rotor root radius and less than a first rotor maximum lobe radius.

20. The compressor system of claim 18, wherein the scavenge passage is configured to direct a scavenge flow through a bearing assembly prior to recirculating the scavenge flow into the rotor cavity.

* * * * *